United States Patent [19]

Zangenfeind et al.

[11] Patent Number: 4,799,076

[45] Date of Patent: Jan. 17, 1989

[54] APPARATUS FOR AFFORDING ACCESS TO EXPOSED BUT UNDEVELOPED FILMS IN A DARK CHAMBER

[75] Inventors: Helmut Zangenfeind, Puchheim; Günther Dömges, Deisenhofen; Reinhart Würfel, Munich, all of Fed. Rep. of Germany

[73] Assignee: AGFA-Gevaert Aktiengesellschaft, Leverkusen, Fed. Rep. of Germany

[21] Appl. No.: 40,868

[22] Filed: Apr. 21, 1987

[30] Foreign Application Priority Data

Apr. 23, 1986 [DE] Fed. Rep. of Germany ..... 8611054

[51] Int. Cl.[4] ..... G03D 17/00

[52] U.S. Cl. ..... 354/308

[58] Field of Search ..... 354/308, 309

[56] References Cited

U.S. PATENT DOCUMENTS

| | | | |
|---|---|---|---|
| 518,074 | 4/1894 | Randolph | 354/308 |
| 617,017 | 1/1899 | Harrison | 354/308 |
| 1,074,373 | 9/1913 | Masko | 354/308 |
| 1,233,441 | 7/1917 | Benko | 354/309 |
| 2,188,299 | 1/1940 | Huerta et al. | 354/308 |
| 3,208,335 | 9/1965 | Doherty | 354/308 |
| 3,314,352 | 4/1967 | Grant | 354/308 |
| 3,826,300 | 7/1974 | Lee | 354/308 |
| 4,178,088 | 12/1979 | Harding | 354/308 |
| 4,179,207 | 12/1979 | Phillips | 354/308 |
| 4,253,788 | 3/1981 | Oaks et al. | 414/403 |

FOREIGN PATENT DOCUMENTS

| | | | |
|---|---|---|---|
| 2326091 | 12/1973 | Fed. Rep. of Germany | 354/308 |

*Primary Examiner*—A. A. Mathews

*Attorney, Agent, or Firm*—Peter K. Kontler

[57] ABSTRACT

Apparatus for affording access to a dark chamber in a housing wherein successive customer films are spliced together has a door with a window which is normally sealed by a pair of sealing devices one of which has a cuff with two normally closed openings for insertion of hands and the other of which has two overlapping curtain panels. The operator inserts the hands into the openings of the cuff and thereupon pushes one or both panels aside to reach into the dark chamber when the need arises. The panels seal the chamber from the outside even if some light penetrates through one or both openings of the cuff, and the openings are filled by the wrists of the operator when the panel or panels are deformed to afford access to a defective film or cassette for film in the dark chamber.

15 Claims, 2 Drawing Sheets

APPARATUS FOR AFFORDING ACCESS TO EXPOSED BUT UNDEVELOPED FILMS IN A DARK CHAMBER

BACKGROUND OF THE INVENTION

The present invention relates to improvements in apparatus for permitting manipulation of containers with exposed but undeveloped films therein in a dark chamber. More particularly, the invention relates to improvements in apparatus which enable the hands of an attendant to gain access to selected containers in the dark chamber.

U.S. Pat. No. 4,253,788 granted Mar. 3, 1981 to Oaks et al. for "Film unloading and handling mechanism" discloses an apparatus which defines a dark chamber for removal of roll film from a spool or cassette and for unwinding of roll film from the core. The apparatus of Oaks et al. further comprises a guide which directs certain defective containers for roll film into a collecting receptacle, and a monitoring device which generates signals in response to detection of defective containers in order to ensure that each defective container is diverted to the guide and enters the collecting receptacle. For example, the monitoring device can ascertain that an exposed film cannot be withdrawn from its container so that the container must be removed for extraction of the confined film in a different way. The collecting receptacle is or resembles a bag, and the containers which accumulate therein cannot be removed except by sealing the room against penetration of light. This is a time-consuming operation because the room must be equipped with means for preventing penetration of radiation which could affect the quality of exposed film frames.

Proposals to avoid the need for conversion of a normally lit room into a dark chamber preparatory to withdrawal of defective containers for exposed but still undeveloped photographic film include the provision of a sealing device which has openings for insertion of hands so that the person in charge can reach the contents of the bag without darkening the room in which the apparatus is installed. The sealing device which is provided with such openings is followed by a second sealing device resembling or constituting a shiftable blind which must be pushed or pulled in a first direction in order to afford access to defective containers and in a second direction counter to the first direction in order to prevent penetration of light into the space for the bag. This is a time consuming procedure and, moreover, the prevention of penetration of light into the space for the bag depends entirely on the conscientiousness of the operator who might forget to return the blind to the sealing position so that light will reach the space for the bag as soon as an operator inserts her or his hands through the openings of the first sealing device. Penetration of light into the space for the bag which contains defective containers can affect the quality of customer films or can entail total damage if the quantity of light is sufficient to render the exposed film in a defective container useless for development and for the making of diapositives or prints therefrom.

OBJECTS AND SUMMARY OF THE INVENTION

An object of the invention is to provide an apparatus which renders it possible to gain access to the interior of a dark chamber for exposed but undeveloped films without permitting entry of light into the chamber.

Another object of the invention is to provide the apparatus with novel and improved means for facilitating and simplifying access to the interior of the dark chamber at frequent or longer intervals and for automatically preventing injury to the person attempting to gain access to the chamber when the need for reaching a film in the dark chamber arises.

A further object of the invention is to provide the apparatus with novel and improved means for automatically sealing the adit to the dark chamber when the apparatus operates in the desired or expected manner.

An additional object of the invention is to provide the apparatus with a set of novel and improved sealing devices which prevent penetration of light into the dark chamber.

Still another object of the invention is to provide the apparatus with novel and improved means for maintaining the sealing devices in operative position at all times except when an authorized person is in the process of reaching into the dark chamber.

A further object of the invention is to provide a novel and improved method of normally preventing entry of radiation into the dark chamber of an apparatus for splicing successive customer films to each other.

Another object of the invention is to provide an apparatus which can employ several conventional components which have been found to be satisfactory and reliable in conventional apparatus.

A further object of the invention is to provide a machine for manipulating exposed but undeveloped customer films which embodies the above outlined apparatus.

One feature of the invention resides in the provision of an apparatus for manipulating exposed but undeveloped photographic films which are confined in containers (e.g., in the form of cassettes or cartridges). The apparatus comprises a housing defining an internal dark chamber serving to receive containers for undeveloped films and having a window which affords access to the chamber, and first and second sealing means for preventing penetration of radiation into the chamber by way of the window. The two sealing means are disposed in series, and the first sealing means defines at least one sealable path which permits a hand to pass therealong and to reach the second sealing means. The second sealing means includes a curtain having at least one panel which is movable by the hand extending along the aforementioned path to permit entry of the hand into the chamber by way of the window so that the hand can reach and manipulate, for example, withdraw film from, a selected container.

The curtain can comprise a pair of opaque panels each of which has a first marginal portion sealingly affixed to the housing, a second marginal portion and means for biasing the second marginal portion of the one panel to a predetermined position in which the panels at least partially overlap each other. The second marginal portion of the one panel is movable from the predetermined position against the opposition of the biasing means by the hand which extends along the aforementioned path so that the hand can enter the chamber by advancing between the two panels. The biasing means can comprise an elongated elastic member (e.g., a rubber band) which is operatively connected with the second marginal portion of the one panel. The second marginal portion of the one panel can define a channel for the band. The first and second marginal portions of the two panels are preferably disposed opposite each other and the one panel can overlie approximately one-half of the other panel of the curtain in the predetermined position of the second marginal portion of the one panel. The end portions of the elongated elastic member are preferably affixed to the housing at the outer side of the window. The elastic member further includes second portions which are adjacent the respective end portions and are, or can be, inclined with reference to a straight line connecting the end portions of the elastic member. The second portions of the elastic member flank the second marginal portion of the one panel and are preferably mirror symmetrical to each other with reference to a plane extending at right angles to the aforementioned straight line. Each second portion can make with the straight line an angle of 15–25 degrees, preferably approximately 20 degrees.

The window can have a width of at least three hand breadths, and the curtain preferably extends laterally beyond opposite sides of the window by approximately one hand breadth at each side. In many instances, the window is or can be rectangular and the one panel extends laterally beyond the shorter sides of the rectangular window.

A receptacle can be provided in the chamber for deposition of selected containers therein. The receptacle is preferably placed close to the lower portion of the window which can be located in a vertical plane.

The apparatus can further comprise means for detecting defective containers in the chamber, and such defective containers constitute, or can constitute, the aforementioned selected containers.

The first sealing means can be provided with two openings which define two discrete paths for the hands of an operator who is in charge of manipulating selected containers in the chamber. The first sealing means is preferably deformable and comprises means for normally sealing the openings therein.

The panels of the second sealing means are or can be mirror symmetrical to each other, and the one panel is preferably the upper panel whose lower (second) marginal portion overlies the upper (second) marginal portion of the lower panel.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 3:
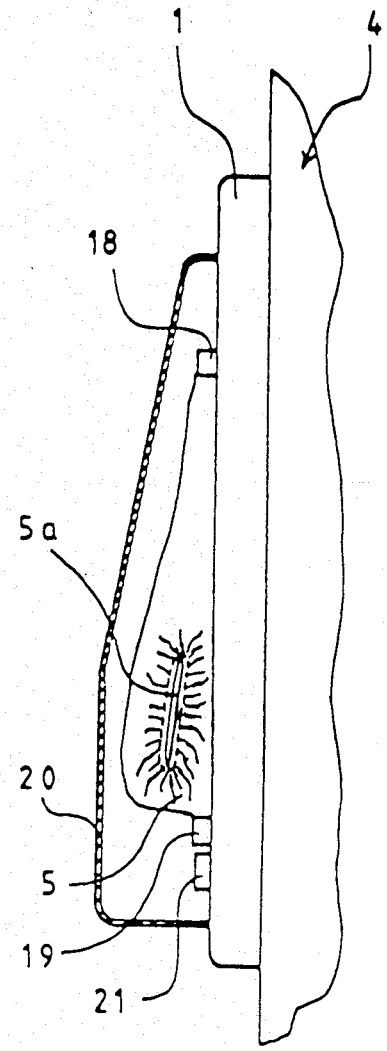
FIG. 3 is a similar sectional view as seen in the direction of arrow 3 in FIG. 1, showing the first sealing means in collapsed condition.
Figure 2:
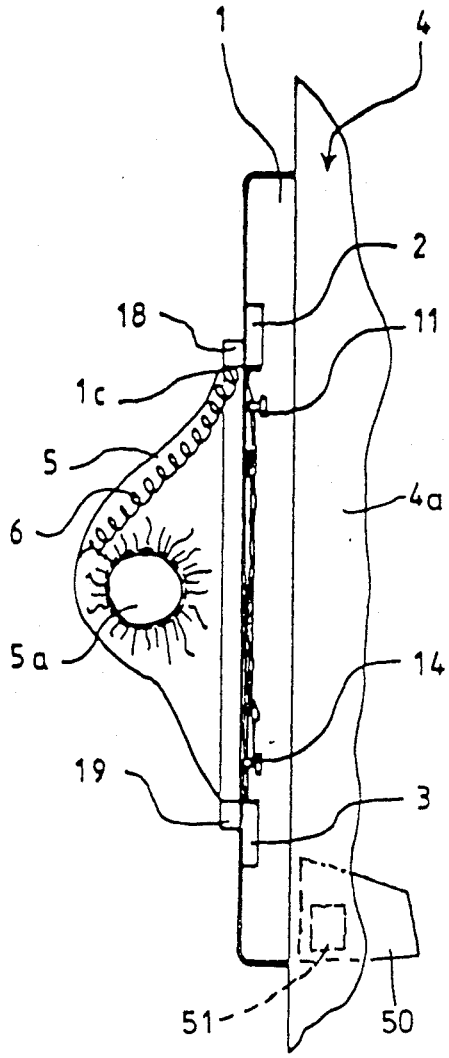
FIG. 2 is a schematic vertical sectional view as seen in the direction of arrows from the line 2—2 of FIG. 1, the openings of the first sealing means being shown in expanded positions to permit the hands of an operator to pass therethrough and to reach the second sealing means.

The drawing shows an apparatus which comprises a housing 4 defining a dark chamber 4*a* and having a portion constituting a door which is reinforced by two horizontal beams 2, 3 mounted on pintles 2*a*, 3*a* so that the door can be swung between the closed position of FIGS. 2–3 and an open position. As a rule, the door 1 is closed. This door can be made of deep-drawn sheet metal. The means for manipulating exposed but undeveloped customer films in the interior of the housing 4, for monitoring the films (e.g., for ascertaining whether or not a customer film has been or can be properly withdrawn from its cassette and has been or can be properly introduced into a path for advancement to a reel on which a large number of customer films are convoluted after having been spliced together end-to-end prior to transport to a developing machine) and for generating signals denoting the presence of a defective customer film is or can be constructed in a manner as disclosed in the aforementioned U.S. Pat. No. 4,253,788. The disclosure of this patent is incorporated herein by reference.

The beams 2, 3 are secured to the inner side of the door 1 by spot welding or in another suitable way and extend across the full width of the door to enhance its rigidity and to thus reduce the likelihood of penetration of light into the dark chamber 4*a* when the door is held in closed position. The provision of beams 2 and 3 render it possible to make the door 1 of a relatively thin metallic sheet material.

The door 1 is provided with an elongated rectangular window 1*b* which is disposed between the beams 2, 3. The height of the illustrated window 1*b* exceeds half the height of the door 1 and the width of the window exceeds half the width of the door. In accordance with a presently preferred embodiment of the invention, the width of the window 1*b* is not less than three hand breadths and the height of the window need not be less than two hand breadths. This renders it possible to readily insert two order to allow for convenient manipulation of a defective film or a defective cassette for film without opening the door 1.

The door 1 has an outwardly extending rectangular stiffening or reinforcing frame 1*c* which surrounds the window 1*b* and the inner side of which supports a substantially roof-shaped first sealing device resembling a cuff and made of a flexible textile or other material which does not transmit light. The upper marginal portion of the sealing device 5 is sealingly secured to the inner side of the door 1 by a first sealing strip 18, and a second sealing strip 19 is provided to connect the door 1 with the lower marginal portion of the sealing device 5. The two lateral marginal portions of the sealing device 5 are or can be sealingly secured to the inner side of the door 1 in a similar way. As can be seen in FIGS. 2 and 3, the marginal portions of the sealing device 5 surround the window 1*b* (which is surrounded by the frame 1*c*) and the median portion of the device 5 can extend outwardly through and well beyond the window 1*b* in response to opening of a normally closed second or auxiliary door 20. FIG. 3 shows the second door 20 in closed position in which the sealing device 5 is collapsed and is confined in the frame 1*c* of the door 1. The sealing strips 18, 19 are bolted, screwed, riveted or otherwise (permanently or separably) secured to the inner side of the door 1.

The lateral portions or panels of the sealing device 5 have openings 5a which can have a substantially circular shape (at least in the expanded condition of the respective portions of the sealing device 5) and are normally closed and sealed by suitable sealing elements (e.g., rubber bands) which are received in annular channels or selvages surrounding the respective openings a. The openings 5a define two paths for insertion of the hands of an operator so that the hands can enter the dark chamber way of the window 1b. The bands will cause the material of the sealing device 5 around the openings 5a to sealingly engage the wrists of the respective hands so that, once the wrists are properly received in the openings 5a, the sealing device 5 prevents penetration of any light from the exterior of the housing into the window 1b and thence into the dark chamber 4A.

FIG. 2 shows a coil spring 6 which is connected to the central portion of the sealing device 5 to the left of the openings 5a and to the upper sealing strip 18 (or to a portion of the door 1 in the region of the sealing strip 18) to pull the central portion of the sealing device 5 in a direction to the right, i.e., to prevent excessive bulging or sagging of the device 5 outwardly and beyond the window 1b under the action of gravity. The spring 6 extends substantially diagonally and its upper end portion can be secured to the door 1 nearly or exactly midway between the ends of the sealing strip 18.

The apparatus further comprises a second sealing device which is mounted in parallel with (inwardly of) the sealing device 5 and constitutes a curtain having several flexible opaque panels. The illustrated second sealing device or curtain has two panels including an upper panel 7 and a lower panel 8. The material of the panels 7 and 8 is or can be the same as that of the sealing device 5.

The elongated upper marginal portion of the upper panel 7 is fastened to the underside of the upper beam 2 by an elongated sealing strip 15 and screws, bolts or similar fasteners 17. The lower marginal portion of the lower panel 8 is fastened to the upper side of the lower beam 3 by a second sealing strip 16 and a set of fasteners 17. The lower marginal portion of the panel 7 has a channel which receives the median portion of an elongated elastic member 10 (e.g., a rubber band) the ends of which are secured to the inner side of the door 1 by substantially mushroom-shaped affixing devices 13 and 14 in the form of nails, screws or the like. The panel 7 extends laterally beyond the shorter sides of the window 1b, e.g., by at least one-half of one hand's breadth at each side of the window, and the same preferably applies for the panel 8. The upper marginal portion of the panel 8 has a channel for a second rubber band 9 whose ends are secured to the door 1 by affixing means 11, 12 similar to the affixing means 13 and 14. The positions of the affixing means 13, 14 are selected in such a way that a straight line 107 which extends therebetween is disposed at a level below the lower marginal portion of the panel 7. In other words, the band 10 has second portions which are adjacent its respective ends (at 13, 14) and each of which makes with the line 107 an acute angle alpha, e.g., an angle of 15–25 degrees, preferably approximately 20 degrees. The mounting of the affixing means 11, 12 and the positions of the upper marginal portion of the lower panel 8 and band 9 with reference to a straight line connecting the affixing means 11, 12 are preferably the same as those of the affixing means 13, 14, lower marginal portion of the panel 7 and the band 10 with reference to the line 107. Each of the panels 7 and 8 has two portions or halves which are mirror symmetrical to each other with reference to a plane extending at right angles to the line 107 and disposed midway between the shorter sides of the window 1b.

Figure 1:
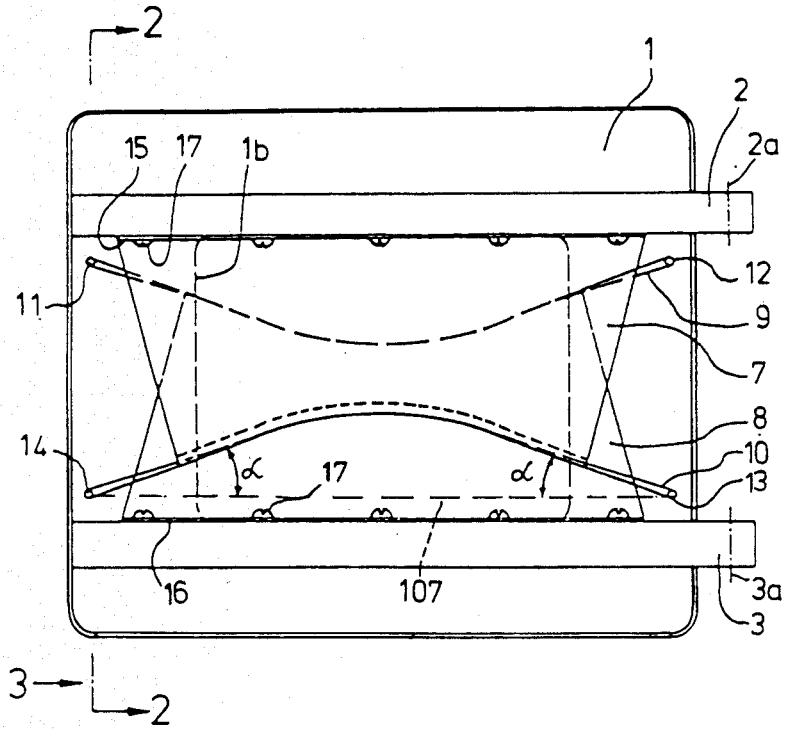
FIG. 1 is a schematic front elevational view of an apparatus which embodies one form of the invention, as seen in the of the chamber.

When the panels 7 and 8 are free to assume their operative or sealing positions (as shown in FIGS. 1 and 2), the upper panel 7 overlies the lower panel 8 and is immediately or closely adjacent thereto so that the panels and 8 cooperate to prevent penetration of light into the dark chamber 4a even if the one and/or the other opening 5a is expanded in a manner as shown in FIG. 2, i.e., even if some light is free to penetrate along one or both paths which are defined by the first sealing device 5. The sealing action is complete when the first sealing device 5 is not deformed at all (as a result of insertion of hands into the openings 5a) and is still more complete when the second door 20 is held in closed position. The second door 20 is pivotably mounted on the frame 1c by one or more vertical or horizontal hinges, not shown. A suitable detent (e.g., a sliding bolt or a hook and eyelet) is provided to releasably hold the second door 20 in a closed and sealing position as shown in FIG. 3. The second door 20 remains closed as long as the automatic film withdrawing and splicing apparatus in the chamber 4a operates properly, i.e., as long as there is no need for manual treatment of a selected film container in the interior of the housing 4.

The apparatus further comprises a switch 21 (e.g., a switch employing one or more reed contacts) which is closed in automatic response to closing of the second door 20 but which opens when the second door 20 is opened to automatically arrest the prime mover or prime movers for mobile parts in the interior of the housing 4 so that the operator's hands cannot be injured upon penetration through the openings 5a, window 1b, between the panels 7, 8 of the second sealing device and into the dark chamber 4a.

The mode of operation of the improved apparatus is as follows:

When the apparatus is in use, the second door 20 is closed to maintain the switch 21 in closed position so that the film manipulating device or devices in the dark chamber 4a automatically withdraw films from their cassettes and splice successive withdrawn films end-to-end to form a long film which is convoluted onto a core or the like preparatory to transport to a developing machine, not shown. Suitable developing machines are manufactured by the assignee of the present application.

When the monitoring means in the housing 4 detects an unsatisfactory customer film (e.g., a cassette which is defective because it does not permit for predictable extraction of exposed film from its shell), the apparatus is arrested by the attendant as a result of opening of the second door 20, i.e., in response to opening of the switch 21. It is clear that the moving parts of the apparatus can be brought to a standstill in a different way or in a second way in addition to opening of the switch 21. For example, the device which detects a defective film can display a suitable signal or generate an audible signal simultaneously with automatic stoppage of the prime mover means. At any rate, all mobile parts of the apparatus are held at a standstill when the apparatus is made ready to permit an operator to reach into the dark chamber 4a order to withdraw a defective film or to eliminate the cause of malfunction so that the apparatus can be restarted.

When the second door 20 is moved to the open position (e.g., the second door can be completely detached from the door 1), the first sealing device 5 extends outwardly through and beyond the window 1*b* so that its (contracted or deformed) openings 5*a* are readily accessible for insertion of two hands. The bands then contract around the wrists of the respective hands to reduce the likelihood of penetration of any light along the material which surrounds the openings 5*a* and on toward the sealing device including the panels 7 and 8. The panels 7 and 8 prevent penetration of any light into the dark chamber 4*a* while the operator is in the process of inserting her or his hands through the openings 5*a* of the first sealing device 5. This ensures that a customer film in the dark chamber 4*a* cannot be accidentally exposed to light even if a portion of such film extends from its cassette within the confines of the housing 4. As a rule, or at least in many instances, the defect which is to be eliminated is to withdraw a cassette for customer film which jams by not permitting extraction of film from its interior.

The hands which have passed through the openings a thereupon lower the inner panel (by stretching the band 9) and reach over the panel 7 or raise the panel 7 so as to gain access to the interior of the housing 4. The operator can also push the median portion of the band 10 toward the chamber 4*a*, as long as such person is then free to reach into the dark chamber 4*a* and to eliminate the cause of malfunction. The defective cassette is detached from the instrumentalities in the chamber 4*b* and is inserted into one of spare (empty) cassettes or cartridges 51 a supply of which is kept in a receptacle 50 adjacent to the door 1 in the chamber 4*a*, preferably in the lower portion of the chamber 4*a* close to the vertical plane of the window 1*b*. The interior of the selected spare cassette or cartridge 51 is thereupon sealed by a spare cover or cap (not specifically shown) which is kept in a position of readiness in the chamber 4*a* or is brought into the housing 4 by one of the hands so that the cartridge 51 can be properly sealed prior to withdrawing it by way of one of the openings 5*a*. The receptacle 50 constitutes an optional feature because one of the hands which extend through the openings 5*a* can be used to bring along an empty cassette 51. A filled cassette 51 is removed by way of the gap between the panels 7, 8 and thereupon through one of the openings 5*a*. Extraction of a cassette 51 from the housing 1 does not entail penetration of any light into the chamber 4*a* because the sealing device including the panels 7, 8 closes as soon as the cassette 51 is moved into the space within the confines of the first sealing device 5 so that eventual penetration of some light between the two sealing devices during extraction of hands from the respective openings 5*a* cannot result in damage to unexposed films in the chamber 4*a*. The bands 9 and 10 are sufficiently strong to return the panels 8 and 7 to the sealing positions of FIG. 1 as soon as the panels are no longer positively held away from such positions.

When the extraction of a cassette 51 is completed, the operator closes the door 20 so that the switch 21 is free to start the prime mover means and the apparatus is restarted, i.e., the apparatus can receive a fresh cassette with unexposed customer film for attachment of such film to the trailing end of the preceding customer film.

The improved apparatus can be modified in a number of ways without departing from the spirit of the invention. For example, at least one of the bands 9, 10 (e.g., the band 10) can be modified in the following manner: The single band 10 is replaced with two shorter bands one of which is connected to the affixing element 13 and to the adjacent end of the lower marginal portion of the panel 7, and the other of which is connected to the affixing element 14 and to the adjacent end of the lower marginal portion of the panel 7.

An important advantage of the improved apparatus is its simplicity. The apparatus is reliable in spite of such simplicity and is ready for operation, as soon as the cause of malfunction is eliminated, by the simple expedient of closing the second door 20. The manner of gaining access to the interior of the housing 4 can be learned in no time by a skilled, semiskilled or even unskilled person, and the danger to the operator is practically nil.

The second door 20 and the switch 21 constitute optional but desirable and advantageous features of the improved apparatus, the same as the receptacle 50.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art and, therefore, such adaptations should and are intended to be comprehended within the meaning and range of equivalence of the appended claims.

What is claimed is:

1. Apparatus for manipulating exposed but undeveloped photographic films which are confined in containers, comprising a housing defining an internal chamber arranged to receive containers for undeveloped films and having a window affording access to said chamber; and first and second sealing means for preventing penetration of radiation into said chamber by way of said window, said sealing means being disposed in series and said first sealing means defining at least one sealable path which permits a hand to pass therethrough and to reach said second sealing means, said second sealing means including a curtain having an opaque upper panel and an opaque lower panel, one of aid panels overlying the other of said panels and at least one of said panels being movable by the hand extending along said path to permit entry of the hand into said chamber so that the hand can reach and manipulate, particularly withdraw film from, a selected container, each of said panels having a first marginal portion sealingly affixed to said housing, a second marginal portion and means for biasing the second marginal portion of said overlying panel to a predetermined position in which said panels at least partially overlap each other, the second marginal portion of said overlying panel being movable from said predetermined position against the opposition of said biasing means by the hand which extends along said path so that the hand can enter said chamber between said panels, said biasing means comprising an elongated elastic member having end portions affixed to said housing and second portions adjacent said end portions and flanking the second marginal portion of said one panel.

2. The apparatus of claim 1, wherein the first and second marginal portions of said panels are disposed opposite each other and said overlying panel overlies approximately one-half of the other of said panels in said predetermined position of the second marginal portion of said overlying panel.

3. The apparatus of claim 1, wherein the second marginal portion of said one panel defines a channel for said biasing means.

4. The apparatus of claim 3, wherein said biasing means includes a rubber band.

5. The apparatus of claim 1, wherein said said curtain extends laterally beyond opposite sides of said window.

6. The apparatus of claim 5, wherein said window is rectangular and said one panel extends laterally beyond the shorter sides of said window.

7. The apparatus of claim 1, further comprising a receptacle provided in said chamber for deposition of selected containers therein.

8. The apparatus of claim 7, wherein said window has an upper portion and a lower portion and said receptacle is adjacent the lower portion of said window.

9. The apparatus of claim 1, further comprising means for detecting defective containers in said chamber.

10. The apparatus of claim 1, wherein said window is disposed in a substantially vertical plane.

11. The apparatus of claim 1, wherein said first sealing means has two openings defining two paths for the hands of an operator in charge of manipulating selected containers in said chamber.

12. The apparatus of claim 11, wherein said first sealing means is deformable and further comprising means for normally sealing said openings.

13. The apparatus of claim 1, wherein said curtain comprises an upper panel and a lower panel, said upper panel normally overlying said lower panel.

14. The apparatus of claim 13, panels are substantially mirror symmetrical to each other.

15. Apparatus for manipulating exposed but undeveloped photographic films which are confined in containers, comprising a housing defining an internal chamber arranged to receive containers for undeveloped film and having a window affording access to said chamber; and first and sealing means for preventing penetration of radiation into said chamber by way of said window, said sealing means being disposed in series and said first sealing means defining at least one sealable path which permits a hand to pass therealong and to reach said second sealing means, said second sealing means including a curtain having a pair of opaque panels at least one of which is movable by the hand extending along said path to permit entry of the hand into said chamber so that the hand can reach and manipulate, particularly withdraw film from, a selected container, each of said panels having a first marginal portion sealingly affixed to said housing, a second marginal portion and means for biasing the second marginal portion of said one panel to a predetermined position in which said panels at least partially overlap each other, the second marginal portion of said one panel being movable from said predetermined position against the opposition of said biasing means by the hand which extends along said path so that the hand can enter sand chamber between said panels, said biasing means comprising an elongated elastic member having end portions affixed to said housing and second portions adjacent said end portions and flanking the second marginal portion of said one panel, said second portions being inclined with reference to a straight line connecting said end portions, said second portions being substantially mirror symmetrical to each other and making with said line acute angles of approximately 15–25 degrees.

* * * * *